US006158971A

United States Patent [19]

Takagi

[11] Patent Number: 6,158,971

[45] Date of Patent: Dec. 12, 2000

[54] PUMP

[75] Inventor: Yoshinori Takagi, Inagi, Japan

[73] Assignee: Ohken Seiko Co., Ltd., Tokyo, Japan

[21] Appl. No.: 09/240,882

[22] Filed: Feb. 1, 1999

[30] Foreign Application Priority Data

Feb. 2, 1998 [JP] Japan ..... 10-033552

[51] Int. Cl.[7] ..... F04B 3/00; F04B 5/00; F04B 25/00

[52] U.S. Cl. ..... 417/244; 417/413 R; 417/526

[58] Field of Search ..... 417/526, 244, 417/273, 20, 3, 413 R, 395, 413.1; 399/252

[56] References Cited

U.S. PATENT DOCUMENTS

| | | | |
|---|---|---|---|
| 4,286,932 | 9/1981 | Nagano et al. | 417/526 |
| 4,455,125 | 6/1984 | Irwin | 417/244 |
| 4,540,346 | 9/1985 | Davies | 417/273 |
| 4,624,625 | 11/1986 | Schrenker | 417/20 |
| 5,114,314 | 5/1992 | Fujimoto | 417/3 |
| 5,332,370 | 7/1994 | Nakayama et al. | 417/413 R |
| 5,368,452 | 11/1994 | Johnson et al. | 417/395 |
| 5,554,014 | 9/1996 | Becker | 417/413.1 |
| 5,950,055 | 9/1999 | Yahata et al. | 399/252 |

FOREIGN PATENT DOCUMENTS

| | | |
|---|---|---|
| 100281070 | 9/1981 | Japan . |
| 62-291484 | 12/1987 | Japan . |
| 6-147128 | 5/1994 | Japan . |
| 09053569 | 2/1997 | Japan . |

*Primary Examiner*—Teresa Walberg
*Assistant Examiner*—Leonid Fastovsky
*Attorney, Agent, or Firm*—Pillsbury Madison & Sutro LLP

[57] ABSTRACT

A pump which performs a pumping function by reciprocally moving a piston by driving a connecting rod so as to maintain a pump chamber in an airtight condition with a diaphragm sandwiched between a piston disposed on a side of a pump chamber and the connecting rod, wherein the diaphragm has a planar plate like form as a whole and a curved portion which is transformed around the piston so as to be brought close to the piston.

8 Claims, 15 Drawing Sheets

PUMP

BACKGROUND OF THE INVENTION a) Field of the Invention

The present invention relates to a pump and more specifically a compact decompression pump which utilizes a diaphragm.

b) Description of the Prior Art

As a conventional example of decompression pump which uses a diaphragm, there is known a pump disclosed by Japanese Patent Kokai Publication No. Hei 6-147128.

This depression pump has a configuration shown in FIG. 1 and FIG. 2. FIG. 1 and FIG. 2 are a sectional view and a partially enlarged view thereof, wherein a reference numeral 1 represents a driving motor, a reference numeral 2 designates an output shaft of the motor, a reference numeral 3 denotes a crank base fixed to the output shaft, a reference numeral 4 represents a driving shaft which is studded on the crank base 3 in a condition inclined to the output shaft 2, a reference numeral 5 designates a disk like driving body which is rotatably mounted on the driving shaft 4, and a reference numeral 6 denotes a plurality of pistons which are arranged at equal intervals on circumferential portions of the driving body 5 and reciprocally movable in a plurality of pump chambers 7 which are arranged along a circumference of the driving body 5. A reference numeral 8 represents a diaphragm which connects the pump chamber 7 and the piston 6 so as to maintain the pump chamber 7 in an airtight condition, a reference numeral 9 designates an inlet port which is communicated with the pump chamber 7 by way of a check valve 11, and a reference numeral 10 denotes an exhaust port which is communicated with the pump chamber 7 by way of a check valve 15. The diaphragm 8 has a U sectional shape having a convexity 8*a* which protrudes toward the pump chamber as shown in FIG. 1 and FIG. 2. The convexity 8*a* forms as a whole an annular portion which surrounds the piston 6 and is disposed so that its inside surface and its outside surface are kept at least partially in contact with an outer circumferential surface of the piston 6 and an inside surface of the pump chamber 7 respectively. Accordingly, the diaphragm is not deformed unnecessarily due to decompression in the pump chamber whether the piston 6 is positioned at a left side piston location in FIG. 1 or a right side piston location in FIG. 1 (the piston location shown in FIG. 2), whereby this diaphragm is preferable for use in a decompression pump.

In the diaphragm pump which has the configuration described above, however, a narrow portion 8*c* exists between the diaphragm 8 and the piston 6 since the diaphragm 8 which allows the reciprocal motion of the piston 6 while maintaining it in an airtight condition has the U shape sectional shape and is molded integrally with the piston 6 as shown in FIG. 1. Accordingly, a metal die is liable to be deformed at a stage to integrally mold the diaphragm 8 and the piston 6*a* since a narrow portion (thinned portion) is formed also in the metal die. FIG. 3 shows an outline (a shape of a surface on which a molding is located) of a metal die which is used to integrally mold the diaphragm 8 and the piston 6. An elongated portion which is to form the narrow portion described above is liable to be deformed or broken and it is impossible to maintain the metal die in a desired form for a long time, thereby making it difficult to perform mass production of the diaphragm pump.

SUMMARY OF THE INVENTION

A primary object of the present invention is to provide a decompression pump which is configured to maintain a pump chamber in an airtight condition with a diaphragm sandwiched between a piston located on a side of the pump chamber and a connecting rod, and suck air into the pump chamber from outside the pump chamber by driving the connecting rod so as to reciprocally move the piston, characterized in that the diaphragm is like a planar plate as a whole and has, around the piston, a curved portion which is transformed so as to be close to the piston.

Another object of the present invention is to provide a decompression pump which has the configuration described above, wherein a plurality of pump chamber are arranged and connected in parallel with one another through flow paths.

Still another object of the present invention is to provide a decompression pump which has the configuration described above, wherein a plurality of pump chambers are arranged and connected in series to one another through flow paths.

Still another object of the present invention is to provide a decompression pump which has any one of the configuration described above, wherein a check valve which is disposed between a pump chamber and a suction port or exhaust port communicated with the pump chamber comprises a cylindrical valve body portion, a fixing portion which extends from a bottom of the valve body portion and has a fixing neck portion, and a valve chamber portion which has a diameter nearly equal to an outside diameter of the valve body and an opening at a location corresponding to the valve body portion.

A further object of the present invention is to provide a pump comprising at least a pump chamber which performs a pumping function by increasing and decreasing a capacity thereof, and a valve chamber having an inlet port and an exhaust port communicated with the pump chamber through check valves at least one of which has a cylindrical valve body portion, a fixing portion extending from a bottom of the valve body portion and having a fixing neck portion and an opening having a diameter nearly equal to an outside diameter of the valve body portion and is located at a portion corresponding to the valve body portion.

DETAILED DESCRIPTION OF THE PREFERRED EMBODIMENTS

Figure 4:
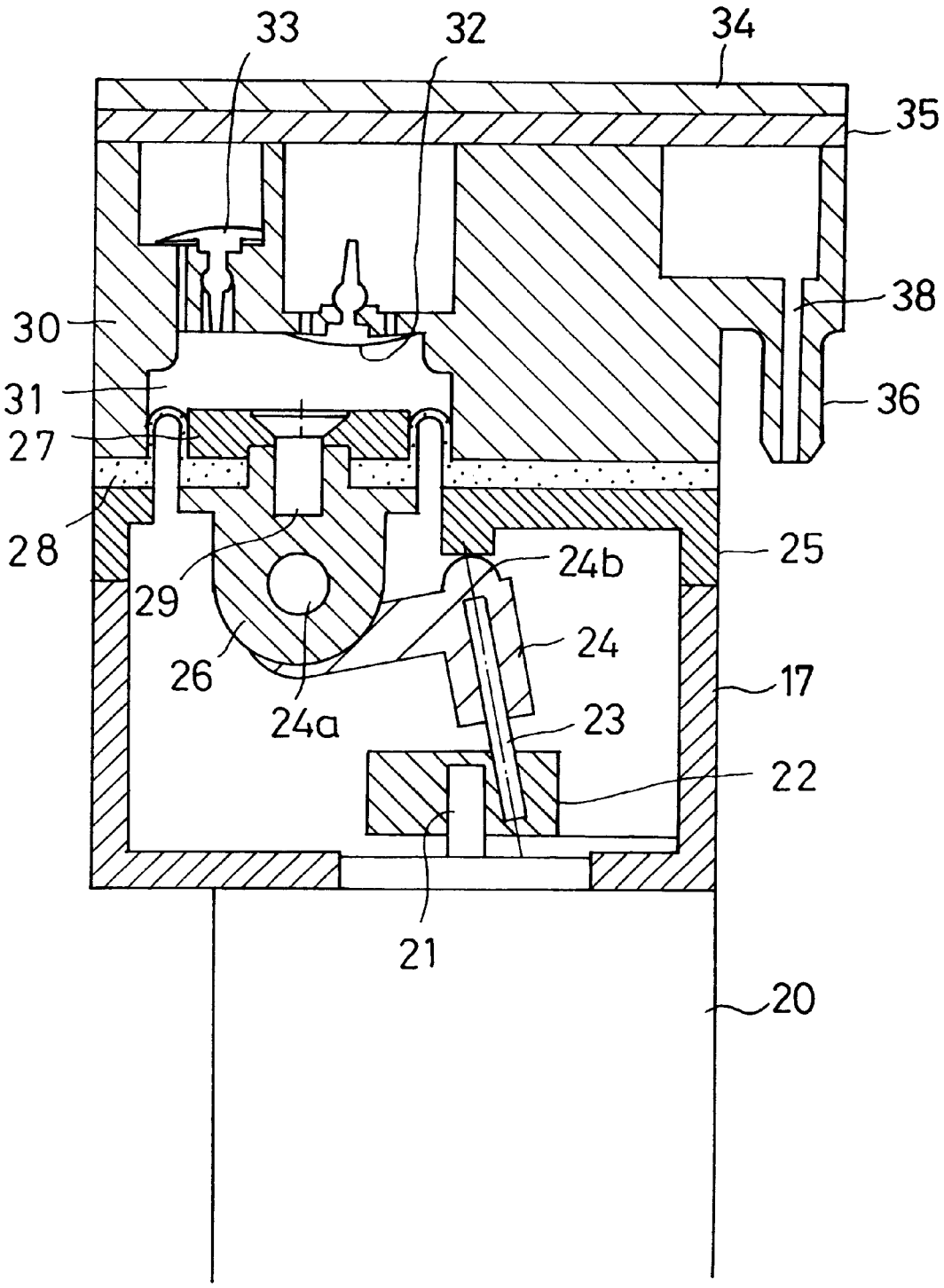
FIG. 4 shows a sectional view illustrating a first embodiment of the decompression pump according to the present invention.

A first embodiment of the present invention is illustrated in FIG. 4, wherein a reference numeral 20 represents a motor, a reference numeral 21 designates an output shaft of the motor 20, a reference numeral 22 denotes a crank base which is fixed to the output shaft 21, a reference numeral 23 represents a driving shaft which is fixed to the crank stand 22 in a condition inclined to the output shaft 21 at a predetermined angle, a reference numeral 24 designates a driving body which is disposed rotatably relative to the driving shaft 23, a reference numeral 25 denotes a cylinder, a reference numeral 26 represents a connecting rod, a reference numeral 27 designates a piston, a reference numeral 28 denotes a diaphragm and a reference numeral 29 represents a screw which fixes the piston 27. A reference numeral 30 designates a housing having a cavity 31. The diaphragm 28 is enclosed and fixed with the housing 30, the cylinder 25 and a case 17, whereby the cavity 31 is sealed by the diaphragm 28 so as to compose a pump chamber. Further, reference numeral 32 and 33 designate check valves, and a reference numeral 34 denotes a cover which is screwed to the housing 30 with the screw by way of a sealing member 35 which is made of an elastic material for maintaining airtightness.

Figure 5:
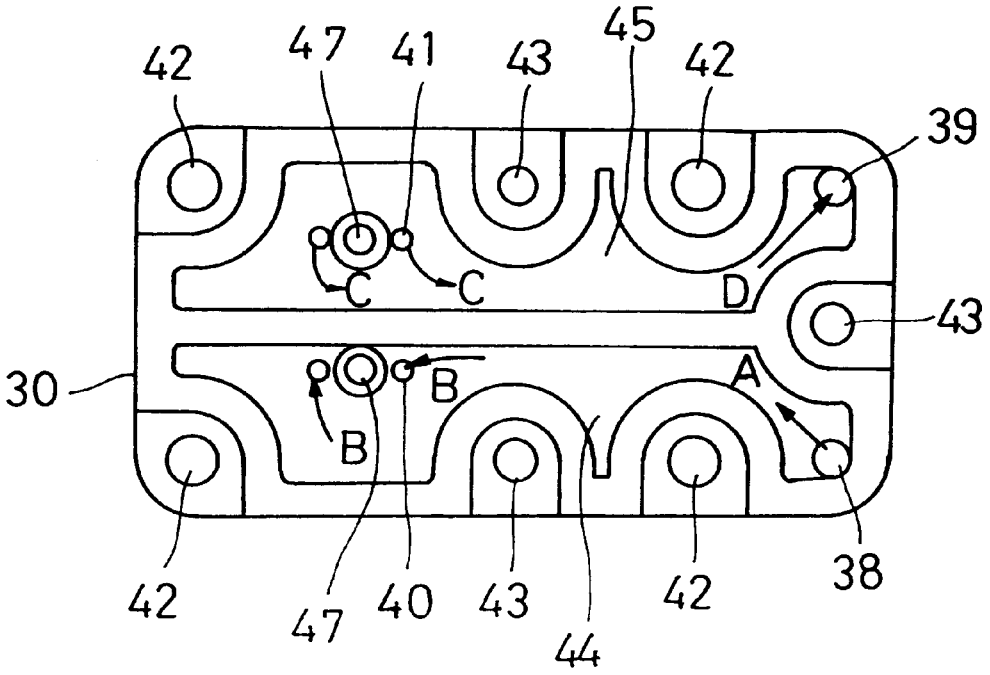
FIG. 5 shows a plan view of a housing for the decompression pump shown in FIG. 4.
Figure 6:
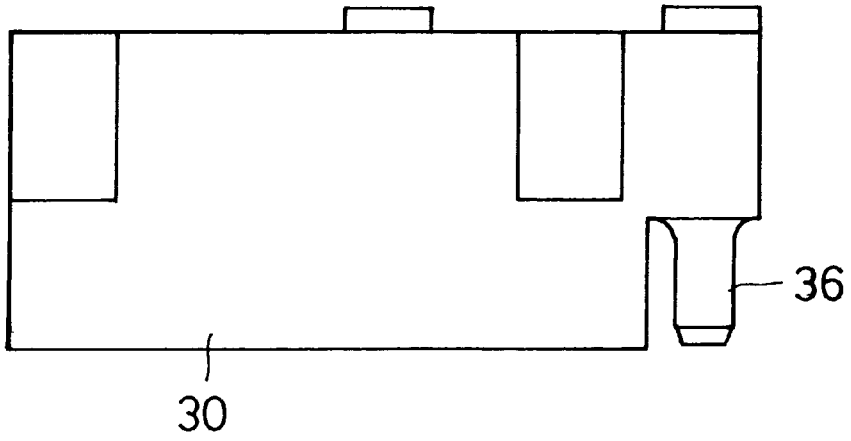
FIG. 6 shows a side view of the housing for the decompression pump shown in FIG. 4.
Figure 7:
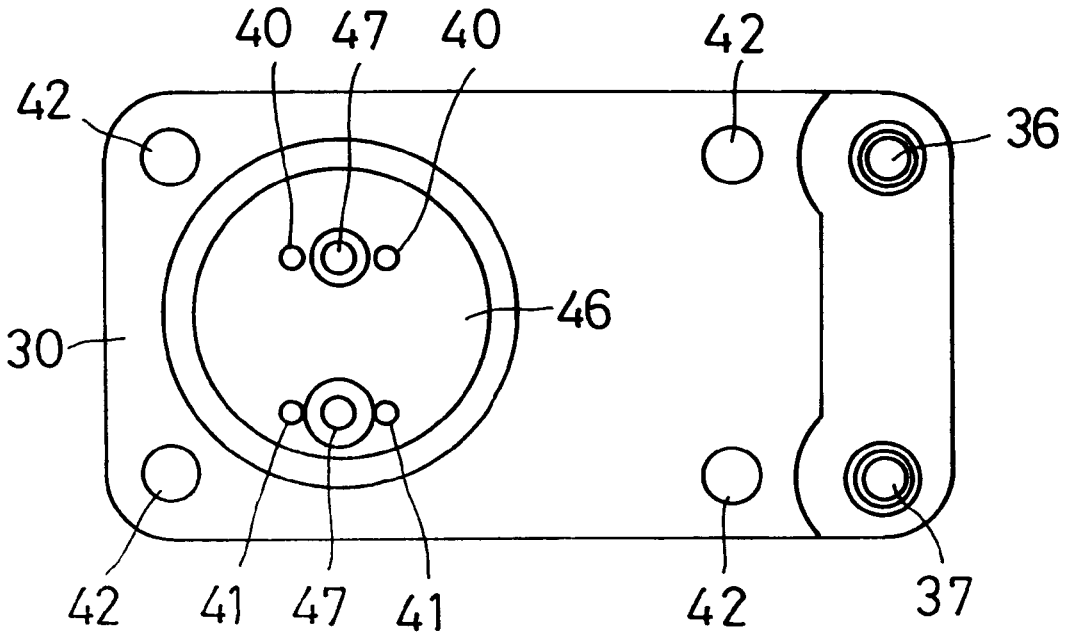
FIG. 7 shows a bottom view of the housing for the decompression pump shown in FIG. 4.

FIGS. 5 through 7 are diagrams illustrating the housing 30: FIG. 5 being a plan view, FIG. 6 being a side view and FIG. 7 being a bottom view. In these drawings, a reference numeral 36 represents an air suction port which is communicated with an inlet port 38 shown in FIG. 5. In the plan view shown in FIG. 5, portions 44 and 45 are formed as cavities which are lower than a top surface of the housing 30 and function as flow paths when the cover 34 is set in position by way of the packing 35 as shown in FIG. 4. Furthermore, a reference numeral 40 represents an orifice which is communicated with a cavity shown in FIG. 7, further with an end of a flow path 45 shown in FIG. 5 by way of an orifice formed in the cavity and with an exhaust port by way of a slot formed at a right end of the flow path.

Description will be made of operations of the first embodiment which has the configuration described above.

When the motor is driven in FIG. 4, the crank base 22 and the driving shaft 23 are rotated around the output shaft 21, thereby moving the driving body 24 like a gooseneck and reciprocally moving perpendicular shafts in the vertical direction to reciprocally move the connecting rod 26, the piston 27 and the diaphragm 28. Accordingly, a volume of the pump chamber 31 is increased and decreased.

A pumping function caused by the increase and decrease of the capacity of the pump chamber will be described below.

When the piston 27 goes down to increase the capacity of the pump chamber 31, air is sucked through the inlet port 38 of the air suction port 36 in a direction indicated by an arrow A in FIGS. 5 through 7, flows through the orifice 40 in a direction indicated by an arrow B, pushes the check valve 32 shown in FIG. 4 and flows into the pump chamber 31. When the piston 27 goes up to decrease the capacity of the pump chamber 31 at the next step, the check valve 32 is closed and the check valve 33 is opened, and the air which has flowed into the pump chamber 31 flows through the orifice 41 in a direction indicated by an arrow C in FIG. 5, passes through another flow path 45 and is exhausted from the exhaust port 39 in a direction indicated by an arrow D.

By moving the piston 27 upward and downward repeatedly as described above, the increase and decrease of the capacity of the pump chamber 31 are repeated, thereby performing the pumping function.

Figure 1:
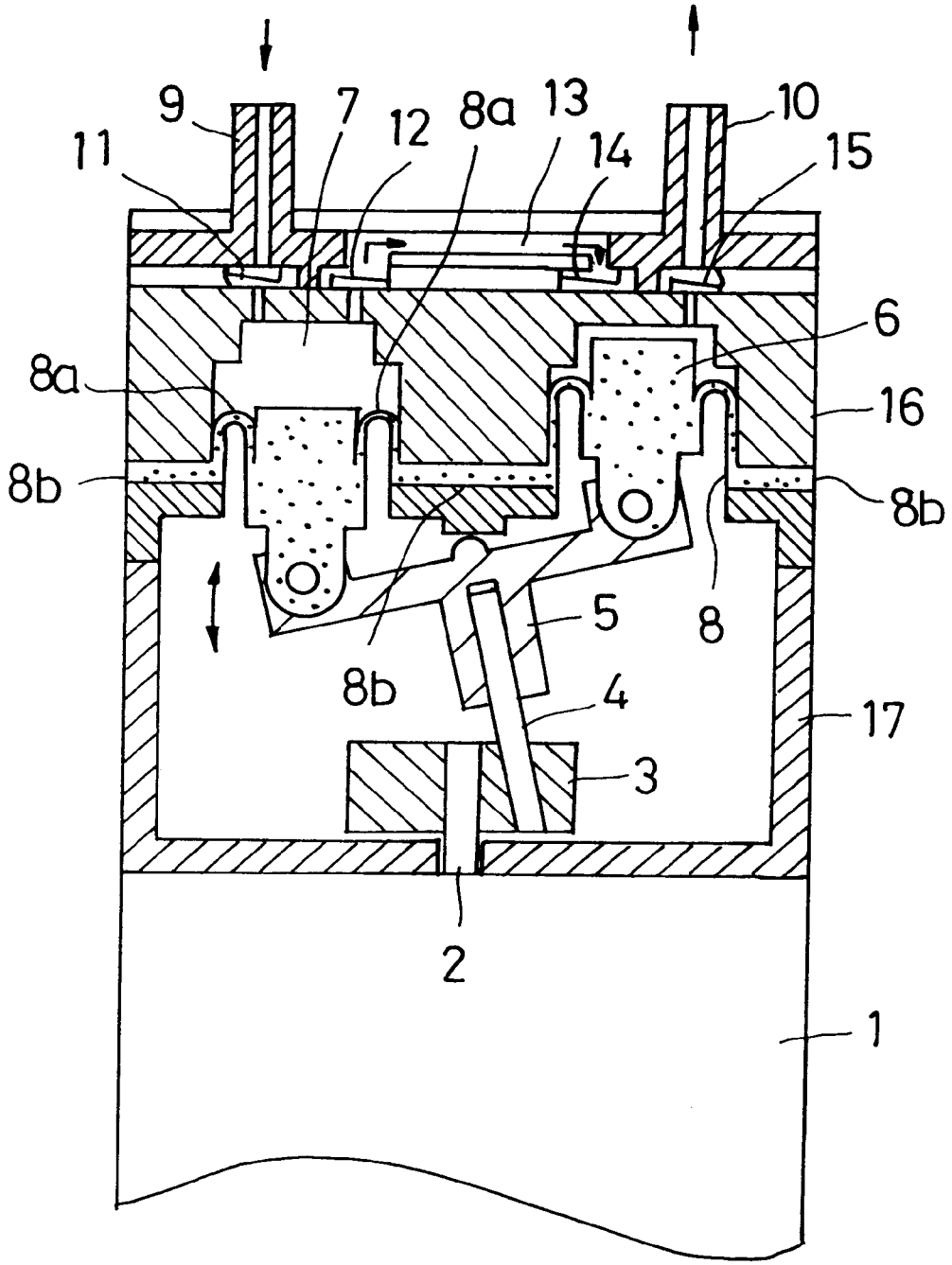
FIG. 1 PRIOR ART
FIG. 1 shows a sectional view illustrating a configuration of a conventional decompression pump which uses a diaphragm.
Figure 2:
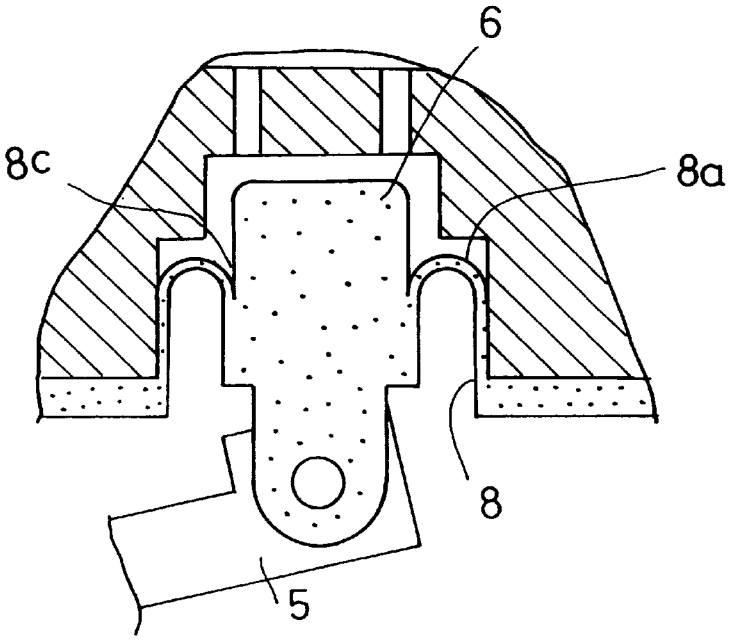
FIG. 2 PRIOR ART
FIG. 2 shows an enlarged sectional view illustrating a portion of the decompression pump shown in FIG. 1.
Figure 3:
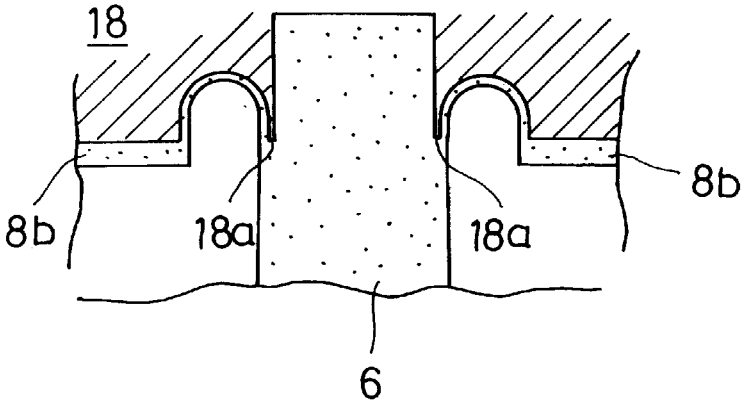
FIG. 3 PRIOR ART
FIG. 3 is a sectional view showing an outline of a metal die used to mold the diaphragm of the conventional pump.
Figure 8:
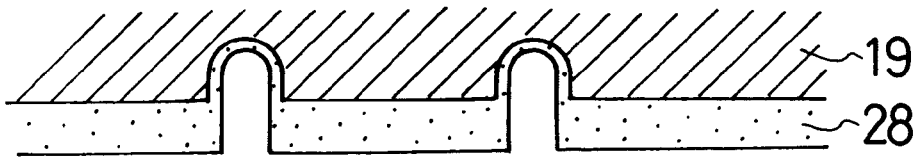
FIG. 8 is a diagram showing an outline of a metal die used to mold a diaphragm which is to be used in the decompression pump according to the present invention.

The diaphragm pump preferred as the first embodiment of the present invention uses the diaphragm 28 which has the sectional shape shown in FIG. 4. Accordingly, the diaphragm 28 has no narrow portion such as the annular portion 8*a* of the diaphragm 8 of the conventional example shown in FIG. 1. In other words, a metal die 19 to be used for forming the diaphragm 28 by molding has a sectional shape outlined in FIG. 8. This metal die has no portion which is thin and has an acute angle unlike a metal die 18 for the conventional example shown in FIG. 3, whereby the metal die can be manufactured easily and enables stable production of the diaphragm pumps. Furthermore, the connecting rod is configured as a member separate from the diaphragm.

When a portion of the diaphragm which surrounds the diaphragm is transformed so as to form a curved portion close to the piston (the U-shaped portion protruding toward the pump chamber in FIG. 4), the diaphragm is not unnecessarily deformed due to decompression in the pump chamber, thereby assuring a favorable pumping function. Furthermore, the diaphragm is planar other than the curved portion or has a shape which facilitates to manufacture a metal die.

FIGS. 9 through 12 illustrate a second embodiment of the diaphragm pump according to the present invention. The second embodiment is an example wherein pump chambers each having two cylinders are arranged in parallel with one another. Speaking concretely, the second embodiment is common in a fundamental configuration to the first embodiment, except for a diaphragm which is composed of two diaphragm members 28*a* and 28*b* integrated with each other, connecting rods 26, pistons 27, pump chambers 31 and so on which are used in pairs respectively, and connecting rods 26 which are engaged with both ends of a driving body 24.

Figure 10:
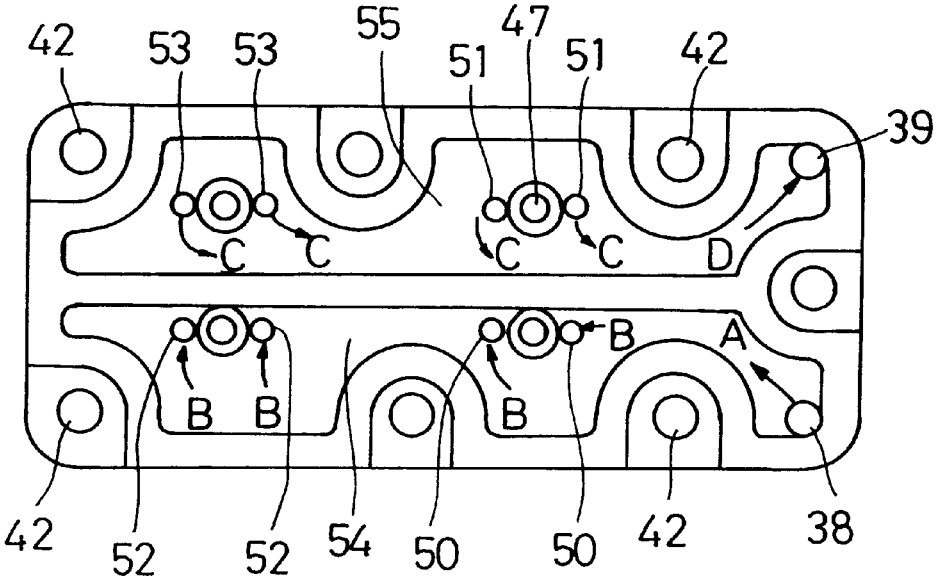
FIG. 10 shows a plan view of a housing for the decompression pump shown in FIG. 9.
Figure 11:
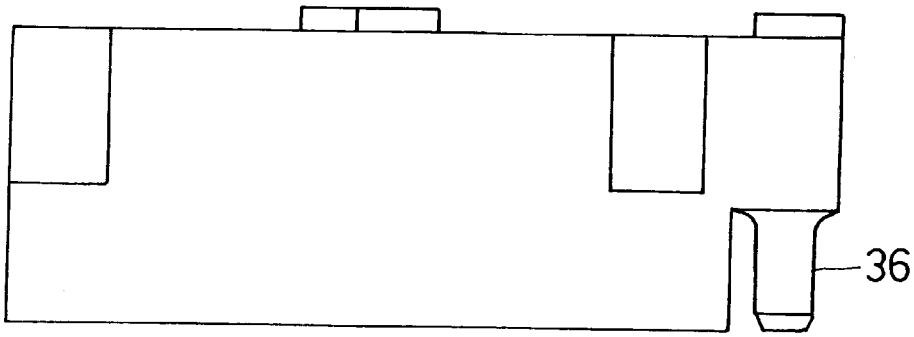
FIG. 11 shows a side view of the housing for the decompression pump shown in FIG. 9.
Figure 12:
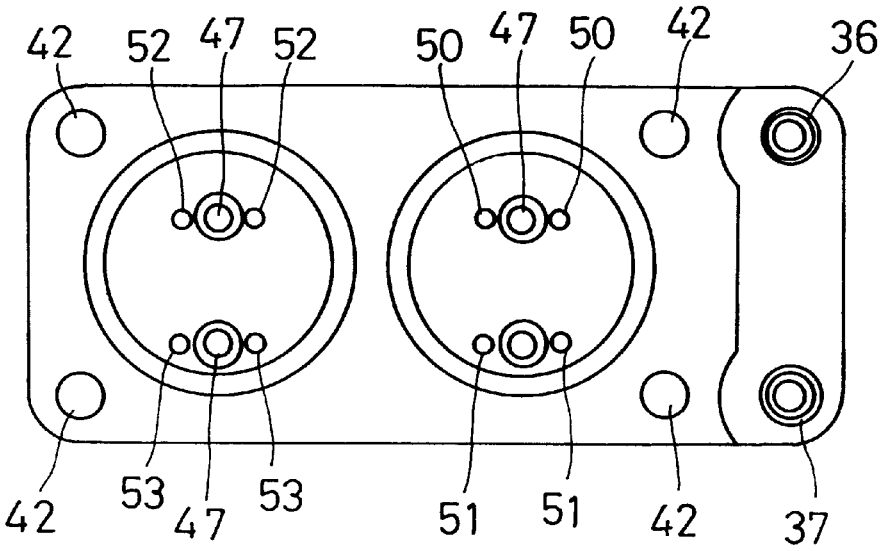
FIG. 12 shows a bottom view of the housing for the decompression pump shown in FIG. 9.

Furthermore, FIGS. 10, 11 and 12 show a plan view, a side view and a bottom view respectively of a housing 30. The diaphragm pump preferred as the second embodiment is different from the first embodiment in that a flow path 54 has an inlet port 38 and orifices 50 and 52 which are formed at locations corresponding two pump chambers, and another flow path 55 also has two pairs of orifices 51 and 53 at locations corresponding to the two pump chambers as shown in FIGS. 10 and 11.

Figure 9:
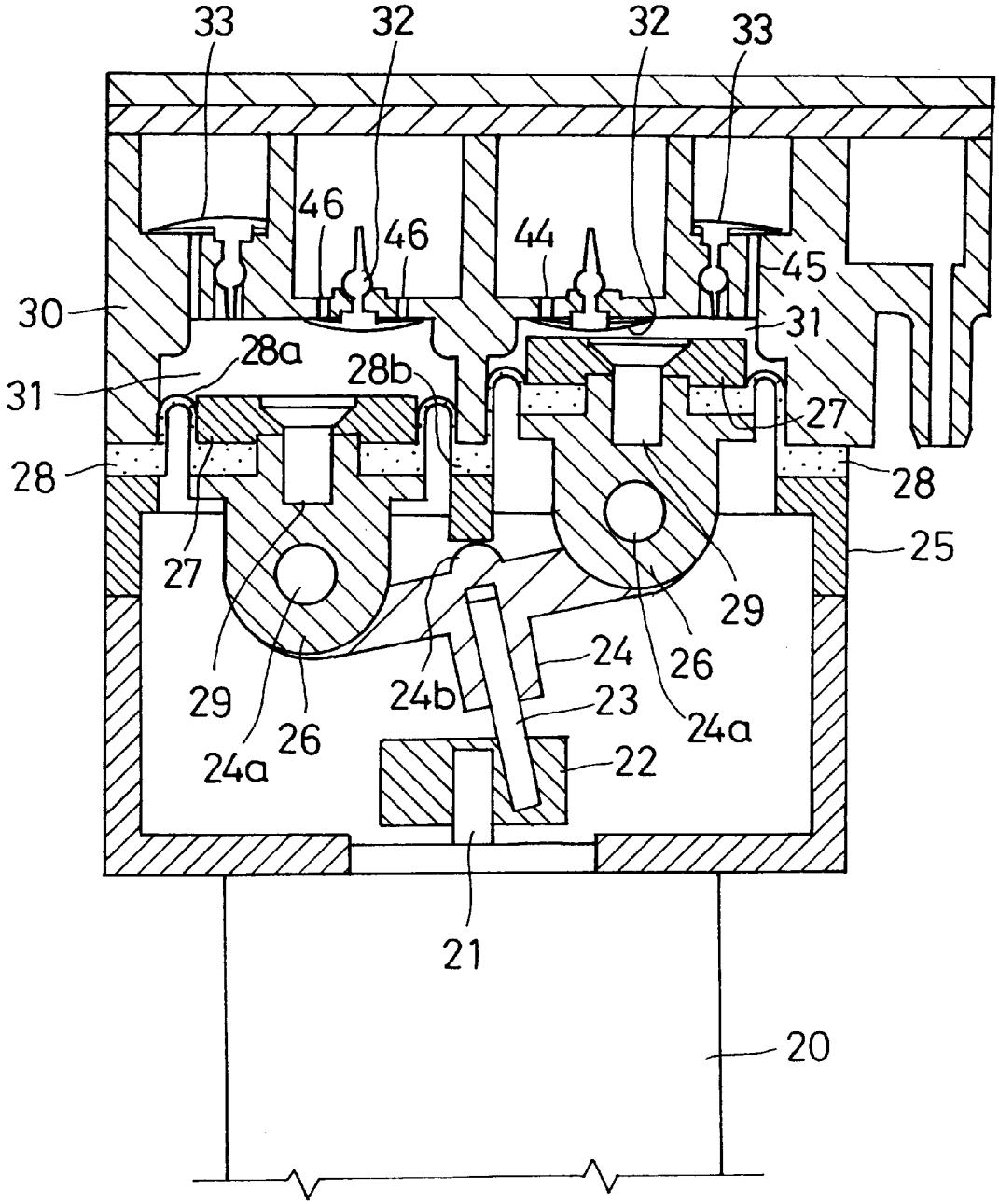
FIG. 9 shows a sectional view illustrating a second embodiment of the decompression pump according to the present invention.

When a motor 20 is driven, the second embodiment performs a pumping function by moving up and down the pistons 26 shown on the right and left sides in FIG. 9 by way of a crank base 22, a driving shaft 23 and driving bodies 26. Speaking concretely, when one of the pistons 27 goes down, a capacity of the pump chamber 31 is increased, and a fluid is sucked through an inlet port 38 in a direction indicated by an arrow A in FIGS. 10 through 12, passes through the flow path 54 into the orifices 50 in directions indicated by arrows B, passes through the orifice 50 shown in the drawing and flows into the pump chamber in which the piston goes down.

Since the other piston 27 goes up in the reverse direction, a fluid in the pump chamber flows through the orifices 53 in the directions indicated by arrows C, passes through the flow path 55 and is exhausted from the exhaust port 39.

Air is sucked by repeating the function described above.

Figure 14:
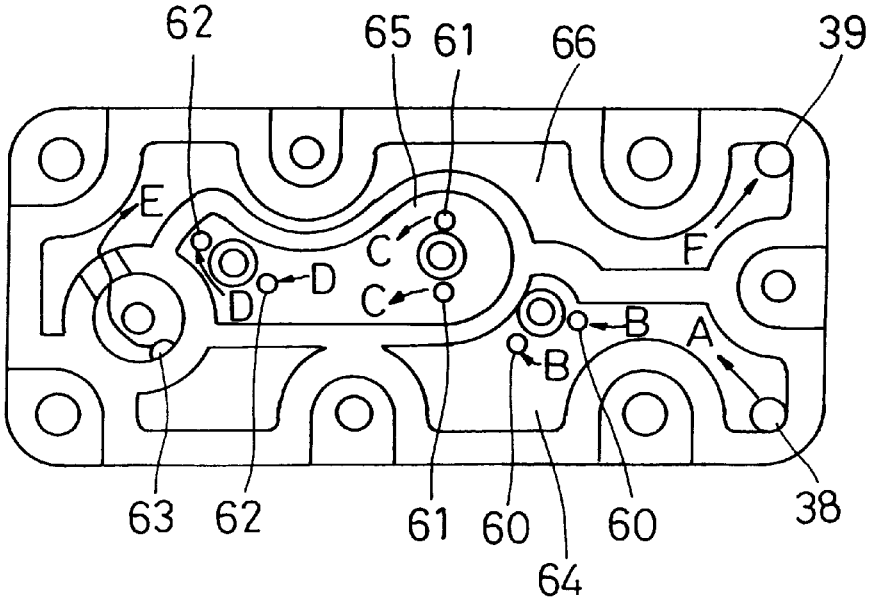
FIG. 14 shows a plan view of a housing for a third embodiment of the decompression pump according to the present invention.
Figure 13:
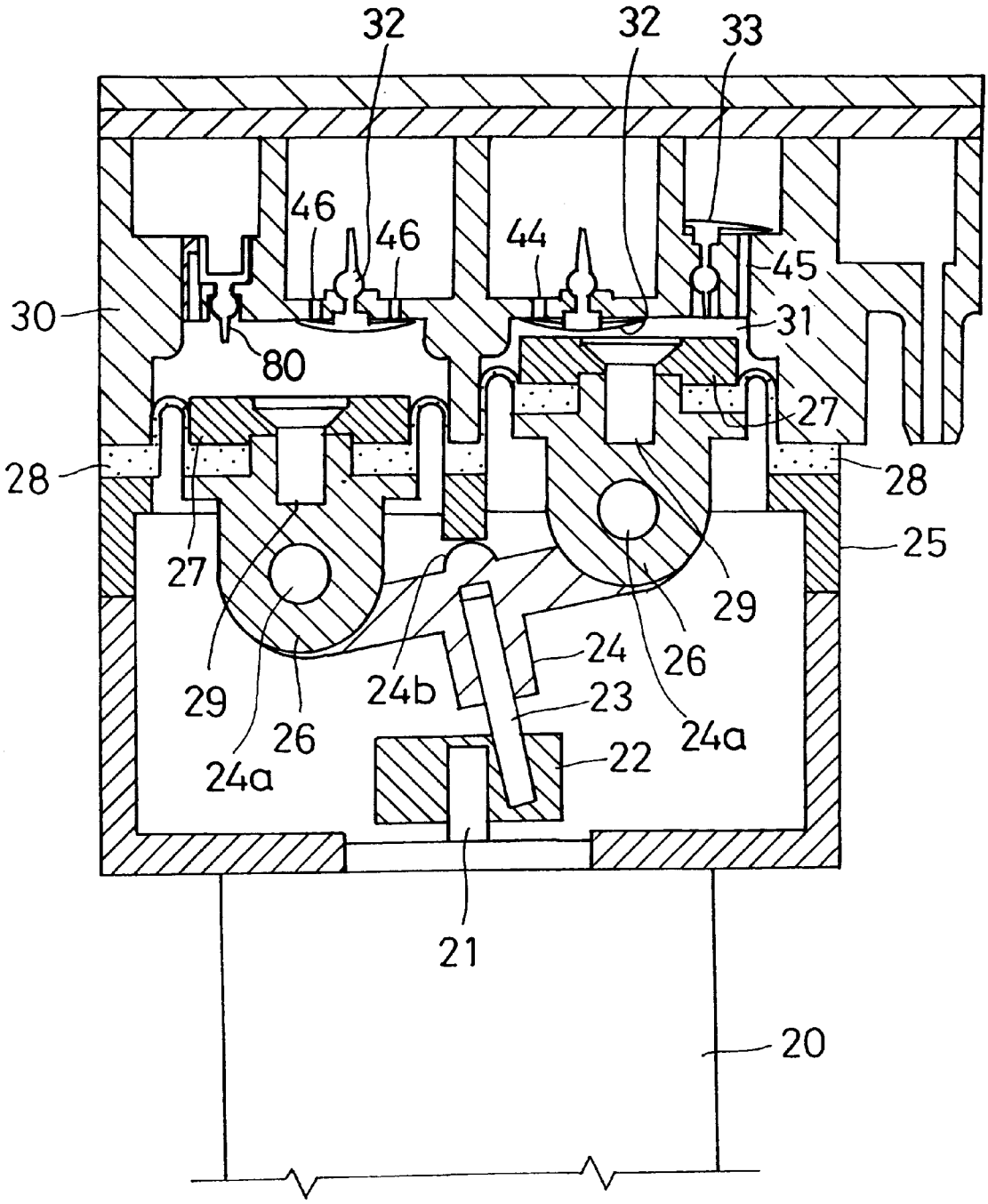
FIG. 13 shows a sectional view illustrating a third embodiment of the decompression pump according to the present invention.
Figure 15:
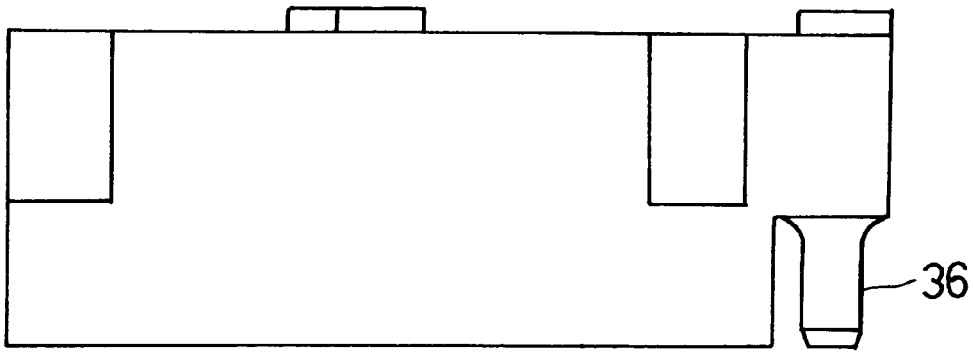
FIG. 15 shows a side view of the housing for the third embodiment of the decompression pump according to the present invention.
Figure 16:
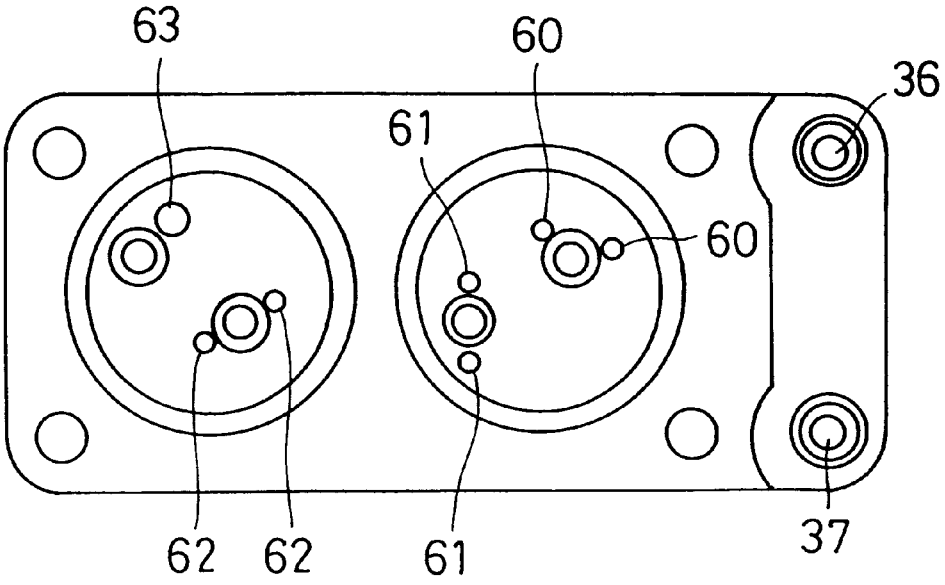
FIG. 16 shows a bottom view of the housing for the third embodiment of the decompression pump according to the present invention.

FIGS. 14 through 16 show a housing for a third embodiment of the diaphragm pump according to the present invention. The third embodiment is a diaphragm pump which has two pump chambers like the second embodiment but adopts two pumps which are connected in series in contrast to the two pumps connected in parallel in the second embodiment. The third embodiment is therefore substantially the same as the second embodiment, except a configuration of flow paths, etc. in the housing.

FIG. 14 is a plan view of the housing, FIG. 15 is a side view of the housing and FIG. 16 is a bottom view of the housing. In the third embodiment, a first flow path 64 from an inlet port 38 to orifices 60 toward a first pump chamber, a second flow path 65 for sending a fluid from the first pump chamber into a second pump chamber and a third flow path 66 from the second pump chamber toward an exhaust port are formed as shown in FIG. 14. Accordingly, the inlet port 38 and the orifices 60 toward the first pump chamber are formed in the first flow path 64, orifices 61 for flowing the fluid from the first pump chamber and orifices 62 for sending the fluid from the flow path 64 into the second pump chamber are formed in the second flow path 65, and an orifice 63 for flowing the fluid from the second pump chamber and an exhaust port 39 are formed in the third flow path 66.

When a piston is lowered in the first pump chamber, the third embodiment of the present invention sucks the fluid through the inlet port 38 and flows the fluid into the first pump chamber through the flow path 64 and the orifices 60. At the next step, the diaphragm pump raises the piston 27 in the first pump chamber, thereby sending out the fluid from the first pump chamber into the second flow path 65 through the orifices 61. Since a piston is lowered in the second pump chamber to such the fluid at this step in contrast to the piston in the first pump chamber, the fluid which is sent into the second flow path 65 flows into the second pump chamber through the orifices 62. Successively, the piston is raised in the second pump chamber to send the fluid from this pump chamber through the orifices 63 into the third flow path 66 and exhaust it from the exhaust port 39.

Since the piston is lowered in the first pump chamber at this step, the fluid is sucked through the inlet port and flows into the first pump chamber through the first flow path.

The diaphragm pump performs a suction type pumping function by repeating the operation described above.

Figure 17:
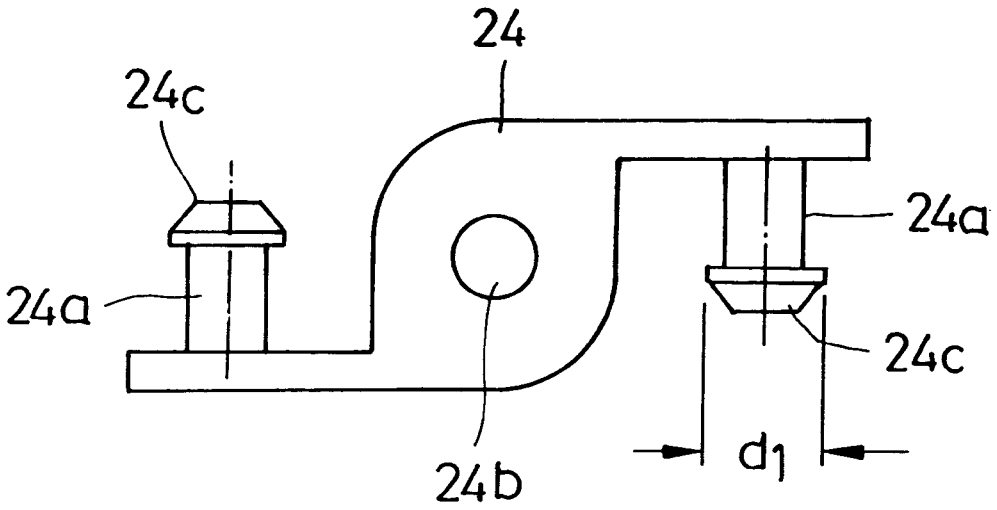
FIG. 17 shows a sectional view illustrating a configuration of a driving body to be used in the decompression pump according to the present invention.
Figure 18:
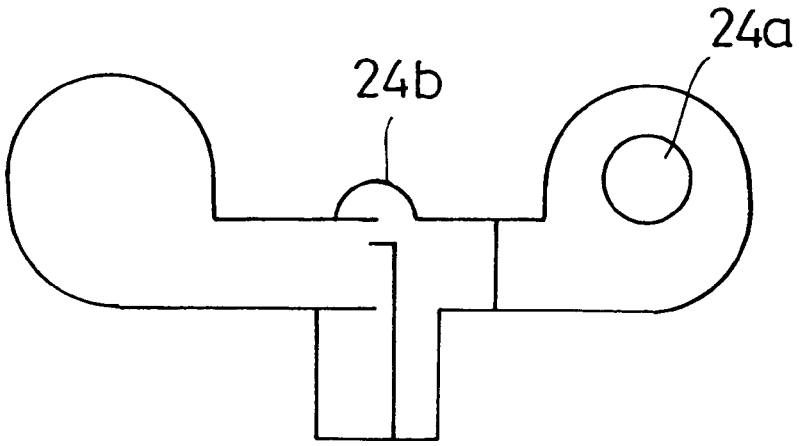
FIG. 18 shows a sectional view illustrating another configuration of the driving body to be used in the decompression pump according to the present invention.
Figure 19:
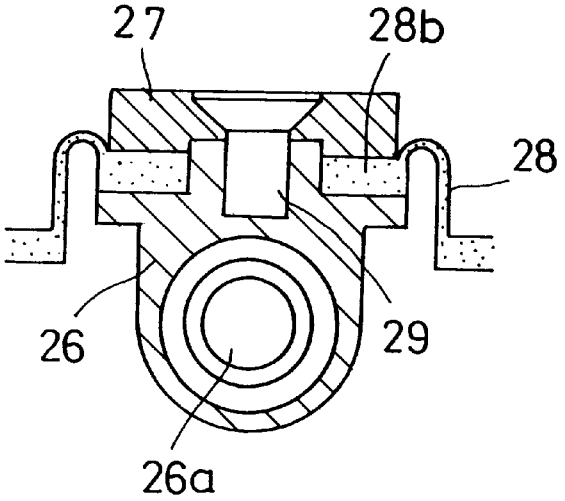
FIG. 19 shows a sectional view illustrating a configuration of a connecting rod to be used in the decompression pump according to the present invention.
Figure 20:
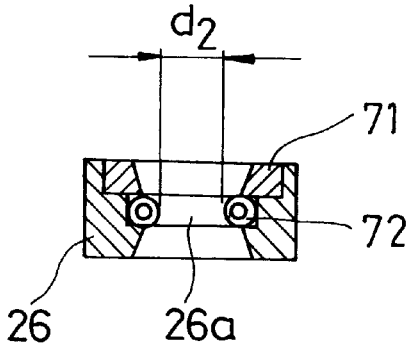
FIGS. 20 and 21 show diagrams illustrating relationship among sizes and the like of parts which compose the connecting rod.
Figure 21:
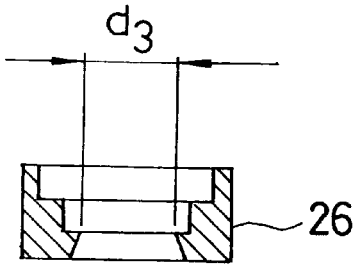

In the diaphragm pumps preferred as the embodiments described above, the driving bodies 24 shown in FIG. 4 and FIG. 9 are configured as shown in FIGS. 17 and 18. Speaking concretely, the driving body has horizontal shaft portions 24*a* in a number of the pump chambers 31 (two in FIG. 17) and a stopper 24*c* is formed at a tip of the horizontal shaft portion 24*a*. On the other hand, the connecting rod 26 which is to engage with the stopper 24*a* is configured as shown in FIGS. 19, 20 and 21. Speaking concretely, a planar portion 28*b* in the middle of the diaphragm 28 is sandwiched between the connecting rod 26 and the piston 27, and fixed with a screw 70 to maintain this portion in an airtight condition. Furthermore, the connecting rod 26 contains an O ring 72 which is covered with a soldered lid. A diameter $d_2$ of the O ring 72, an inside diameter $d_3$ of the connecting rod 26 and a diameter $d_1$ of the stopper of the horizontal shaft portion of the driving body 24 are set in relationship which defined below. In addition, a reference numeral 24*b* represents a convexity.

$$d_2<d_1<d_3$$

Owing to the relationship defined above, the driving body 24 can be combined with the connecting rod in a condition where the stopper 24*c* is fitted in the O ring 72.

Out of the embodiments described above, the first and second embodiments use umbrella type check valves. In the third embodiment, however, an umbrella type check valve cannot be used due to spatial restriction in the course from the second pump chamber to the third flow path.

Figure 22:
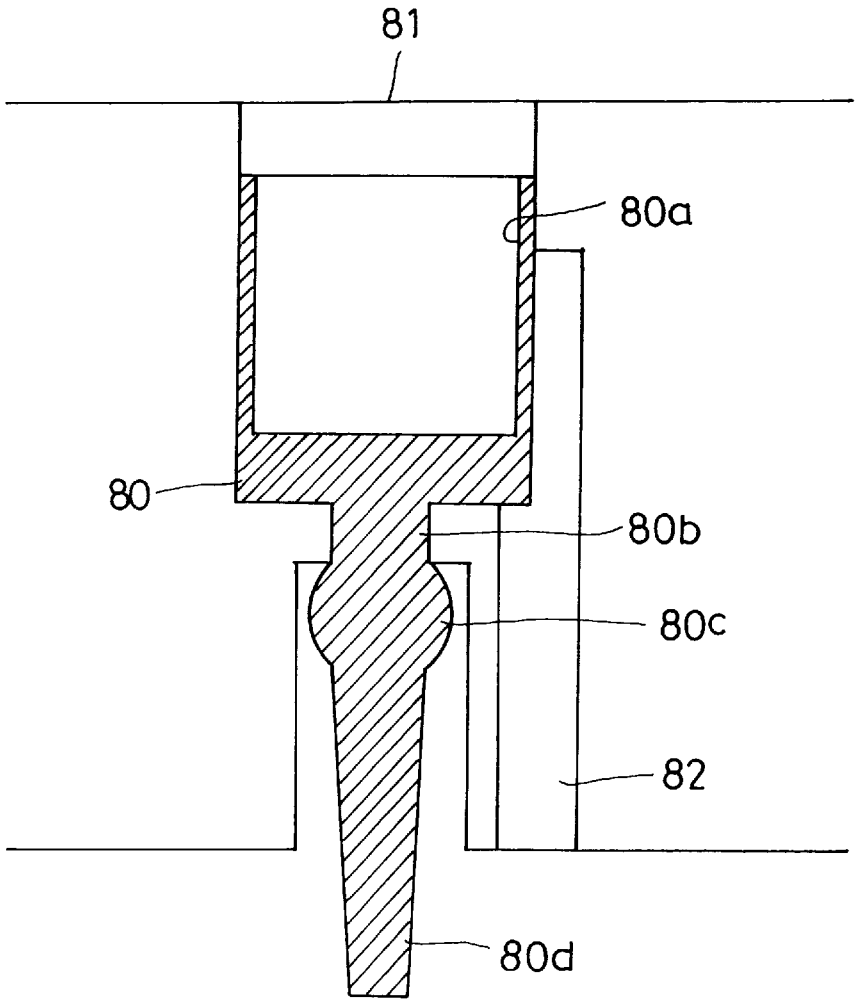
FIGS. 22 and 23 show sectional views exemplifying a check valve to be used in the decompression pump according to the present invention.

In the third embodiment of the present invention, a check valve shown in FIG. 22 is used in the course from the second pump chamber to the third flow path.

In FIG. 22, a reference numeral 80 represents a cylindrical check valve, a reference numeral 80*a* designates a valve body portion, a reference numeral 80*b* denotes a fixing portion, a reference numeral 80*c* represent a neck portion and a reference numeral 80*d* designates a portion which is to be pulled. Furthermore, a reference numeral 81 represents a valve chamber and a reference numeral 82 designates an orifice.

Figure 23:
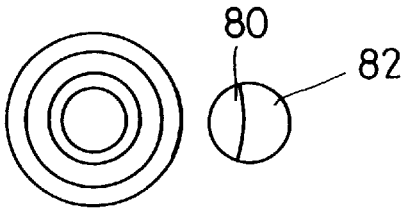

With the portion 80*d* set ahead, the check valve is inserted into the valve chamber 81 from above, and the neck portion 80*c* is forcibly pulled in and the check valve is set in the condition shown in FIG. 22 by pulling the 80*d* which is to be pulled. FIG. 23 shows a bottom view of the check valve shown in FIG. 22.

When an internal pressure of the valve chamber 81 is higher than an internal pressure of the orifice 82, the internal pressure of the valve chamber functions to expand the valve body portion 80*a* and push it to a wall surface 81*a* of the valve chamber 81, whereby the check valve functions to intercept a flow of the fluid. When the internal pressure of the orifice 81 is higher than the internal pressure of the valve chamber 81, in contrast, the valve body portion 80*a* is pushed inward in an opening 82*a* of the orifice 82, whereby a gap is formed between the wall surface 81*a* and the valve body 80*a*, and the fluid flows into the valve chamber from a side of the orifice.

Though the description has been made above of an example wherein the check valves shown in FIGS. 22 and 23 are used in the third embodiment of the present invention, the check valves shown in FIGS. 22 and 23 can be used also in the pumps preferred as the first and second embodiments. The pumps preferred as these embodiments can be made more compact and simpler by using the check valves shown in FIGS. 21 and 22 in these pumps.

Figure 24:
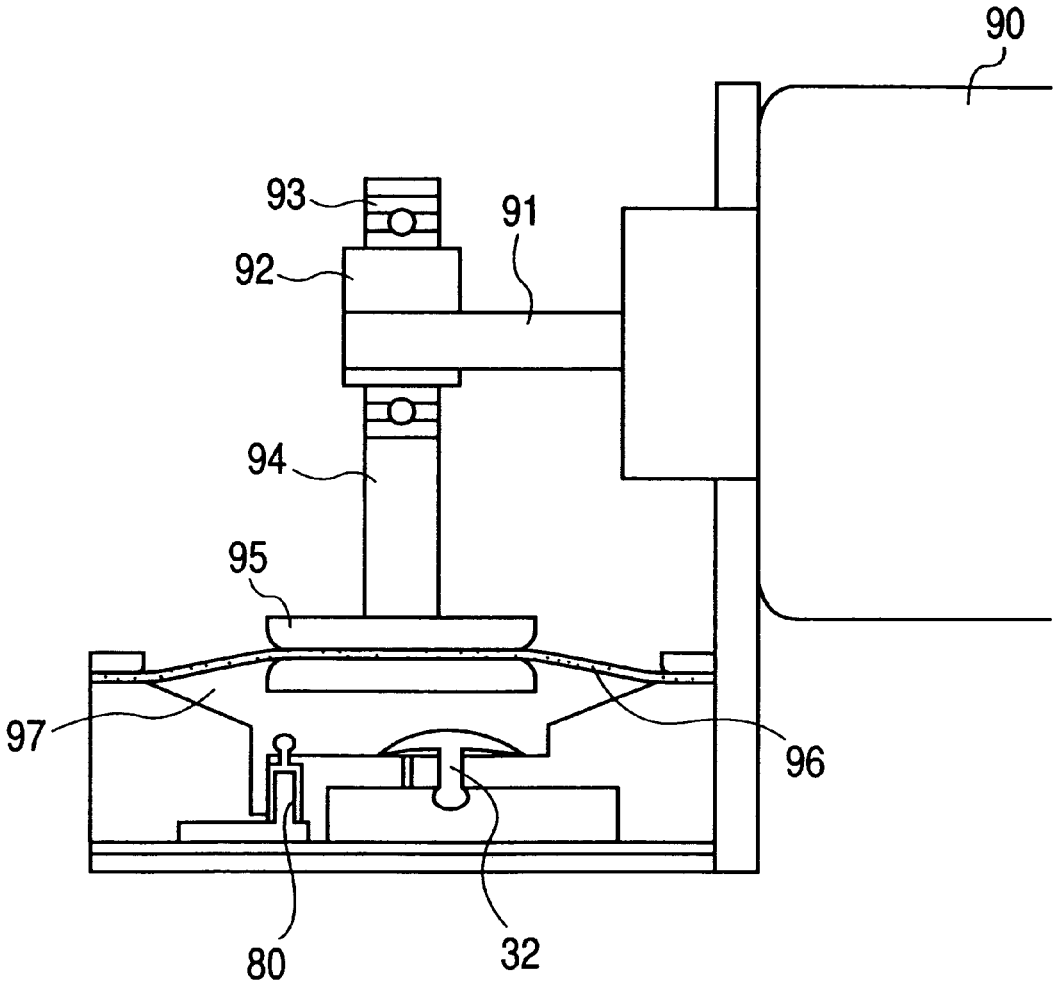
FIG. 24 shows a sectional view illustrating a configuration of another diaphragm pump according to the present invention.

The check valve shown in FIG. 22 is usable not only the vacuum pump according to the present invention but also as a check valve for other pumps and so on which have different configurations. In other words, it is possible by using the check valve shown in FIG. 22 or 23, to simplify and configure more compact a pump which comprises a pump chamber as well as a suction port and an exhaust port communicated with the pump chamber by way of check valves, and performed a pumping function by increasing and decreasing a capacity of the pump chamber. This pump may be, for example, a pump which is configured to increase and decrease a capacity of a pump chamber by driving a driving mechanism so as to transform a diaphragm as shown in FIG. 24, wherein the check valve shown in FIG. 22 or 23 is disposed between the pump chamber and a suction port or an exhaust port. Furthermore, it is conceivable to use the check valve shown in FIG. 21 or 22 as a check valve disposed between a pump chamber and an inlet port or an exhaust port in a pump which increases and decreases a capacity of the pump chamber by reciprocally moving a piston as shown in FIG. 24.

In FIG. 24, a reference numeral 90 represents a motor, a reference numeral 91 designates an output shaft of the motor, a reference numeral 92 denotes an eccentric cam fixed to the output shaft 91, a reference numeral 94 represents a connecting rod which is rotatably attached to the eccentric cam 92, a reference numeral 96 designates a diaphragm which is fixed to the connecting rod 94 with a retainer 95 and a reference numeral 97 denotes a pump chamber.

The pump shown in FIG. 24 moves the connecting rod 94 with the motor 90 by way of the eccentric cam 92, thereby transforming the diaphragm 96 so as to vary a capacity of the pump chamber. The variation of the capacity of the pump chamber cases a pumping function by sucking a fluid through the check valve 32 and exhausting the fluid through the check valve 80.

In this pump, the check valve 32 is an umbrella type valve and the check valve 80 is the valve shown in FIG. 22.

Figure 25:
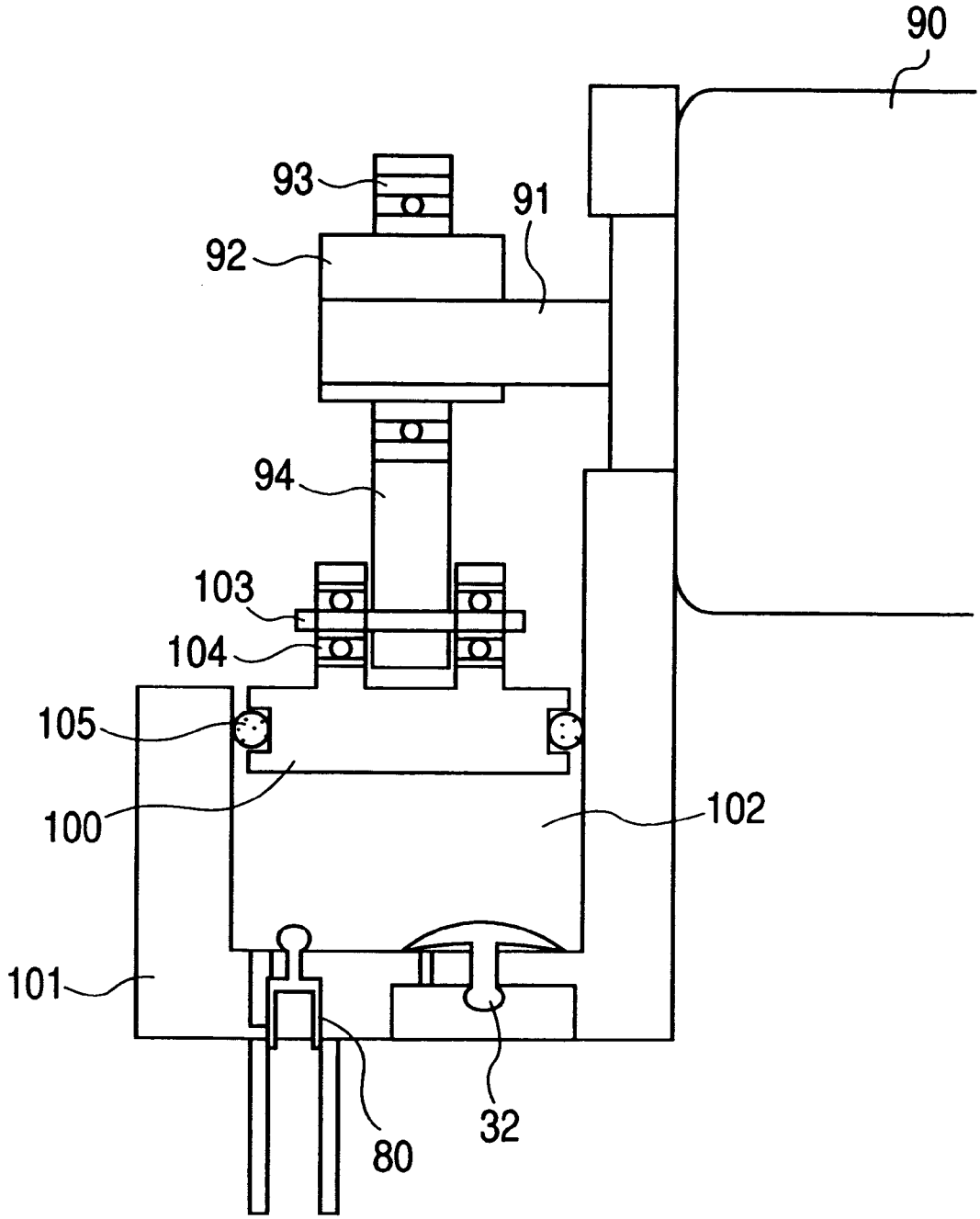
FIG. 25 shows a sectional view illustrating a configuration of a pump which uses the check valve shown in FIGS. 22 and 23, and utilizes a piston according to the present invention.

In FIG. 25, a reference numeral 90 represents a motor, a reference numeral 91 designates an output shaft, a reference numeral 92 denotes an eccentric cam, a reference numeral 93 represents a bearing and a reference numeral 94 designates a connecting rod. Furthermore, a reference numeral 100 denotes a piston, a reference numeral 101 represents a cylinder, a reference numeral 102 designates a pump chamber, a reference numeral 103 denotes a shaft attached to the connecting rod, a reference numeral 104 represents a bearing and a reference numeral 105 designates a sealing member. Furthermore, reference numerals 32 and 80 represent check valves: 32 being an ambrella type valve, and 80 being the valve shown in FIGS. 22 and 23.

This check valve is extremely effective for use at locations where a sufficient space cannot reserved for a valve.

The decompression pump according to the present invention uses a piston holding diaphragm which has a form of a planar plate and is transformed in the vicinity of a piston and provide effects that a metal die to be used for molding the diaphragm can have a durable form, thereby enhancing durabilities of the diaphragm itself and the metal die, and allowing mass production of the diaphragm.

What is claimed is:

1. A decompression pump comprising:

a motor;

a crank base constructed and arranged to rotate around an output shaft of said motor;

a driving shaft attached to said crank base in a condition inclined relative to said output shaft;

a driving body rotatably attached to said driving shaft;

at least one connecting rod attached to said driving body;

a piston attached to said at least one connecting rod;

a housing having at least one pump chamber;

a diaphragm constructed and arranged to maintain said at least one pump chamber in an airtight condition, said diaphragm being arranged between said connecting rod and said piston;

a check valve;

an exhaust port communicating with said at least one pump chamber by way of said check valve; and an inlet port communicating with said at least one pump chamber by way of said check valve;

wherein said diaphragm has a substantially planar plate form and has a curved portion which is provided around said piston so as to be adjacent to said piston.

2. A decompression pump according to claim 1, wherein said curved portion of said diaphragm has a U sectional shape which is convex toward said at least one pump chamber.

3. A decompression pump according to claim 1 or 2, wherein said at least one connecting rod comprises a plurality of connecting rods which are attached to said driving body, wherein said piston is attached to each of said plurality of connecting rods and wherein said at least one pump chamber is disposed at a location corresponding to said piston.

4. A decompression pump according to claim 3, wherein said housing has defined therein a first flow path communicating with said inlet port, and a second flow path communicating with said exhaust port, wherein said at least one check valve comprises two check valves, and wherein said pump chambers communicate with the first flow path and the second flow path by way of said two check valves, and connect in parallel with one another.

5. A decompression pump according to claim 3, wherein said housing has defined therein a first flow path communcating with said inlet port, and a second flow path communicating with said exhaust port, wherein said at least one pump comprises a plurality of pump chambers which communicate with one another through another flow path, one of said plurality of pump chambers communicates with the first flow path, another of said plurality of pump chambers communicates with the second flow path, and all of said plurality of pump chambers are connected in series.

6. A pump comprising: a pump chamber which performs a pumping function by increasing and decreasing a capacity thereof; and an inlet port and an exhaust port which are communicated with said pump chamber by way of check valves respectively, wherein at least one of said check valves has a cylindrical valve body portion, a fixing portion which extends from a bottom of said valve body portion and has a fixing neck portion, and a valve chamber which has a diameter nearly equal to an outside diameter of said valve body portion and an opening at a location corresponding to said valve body portion, and wherein said valve body portion is fixed in said opening with said fixing portion and the neck portion formed thereon so as to assure airtightness between an inside surface of said opening and an outer circumferential surface of said valve body portion.

7. A decompression pump according to claim 1, 2, 4 or 5 wherein said check valve has a cylindrical valve body portion, a fixing portion which extends from a bottom of said valve body portion and has a fixing neck portion, and a valve chamber which has a diameter nearly equal to an outside diameter of said valve body portion and an opening at a location corresponding to said valve body portion, and wherein said valve body portion is fixed in said opening with said fixing portion and said neck portion formed thereon so as to assure an air tight seal between an inside wall of said opening and an outer circumferential surface of said valve body portion.

8. A decompression pump according to claim 1 or 2, wherein said at least one connecting rod comprises a plurality of connecting rods which are attached to said driving body, wherein said piston is attached to each of said plurality of connecting rods, wherein said pump chamber is disposed at a location corresponding to said piston and wherein said check valve has a cylindrical valve body portion, a fixing portion which extends from a bottom of said valve body portion and has a fixing neck portion, and a valve chamber which has a diameter nearly equal to an outside diameter of said valve body portion and an opening at a location corresponding to said valve body portion, and wherein said valve body portion is fixed in said opening with said fixing portion and said neck portion formed thereon so as to assure airtightness between an inside wall of said opening and an outer circumferential surface of said valve body portion.

* * * * *